US010598352B2

(12) United States Patent
Zeng et al.

(10) Patent No.: US 10,598,352 B2
(45) Date of Patent: Mar. 24, 2020

(54) DOWNLIGHT WITH SPRING FIXING STRUCTURE

(71) Applicant: XIAMEN ECO LIGHTING CO. LTD., Xiamen (CN)

(72) Inventors: Maojin Zeng, Xiamen (CN); Xiaobo Chen, Xiamen (CN); Liangliang Cao, Xiamen (CN); Dingwei Liang, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 93 days.

(21) Appl. No.: 15/614,475

(22) Filed: Jun. 5, 2017

(65) Prior Publication Data

US 2018/0306416 A1 Oct. 25, 2018

(30) Foreign Application Priority Data

Apr. 25, 2017 (CN) ..... 2017 1 0277621

(51) Int. Cl.

| | |
|---|---|
| ***F21V 17/16*** | (2006.01) |
| ***F21S 8/02*** | (2006.01) |
| ***F21V 21/18*** | (2006.01) |
| ***F21V 21/04*** | (2006.01) |
| ***F21S 8/04*** | (2006.01) |

(52) U.S. Cl.

CPC ..... *F21V 17/162* (2013.01); *F21S 8/026* (2013.01); *F21V 21/046* (2013.01); *F21V 21/18* (2013.01); *F21S 8/04* (2013.01)

(58) Field of Classification Search

CPC ..... F21S 8/026; F21S 8/04; F21V 17/162; F21V 21/046; F21V 21/18

See application file for complete search history.

(56) References Cited

U.S. PATENT DOCUMENTS

| | | | | |
|---|---|---|---|---|
| 7,234,674 | B2 * | 6/2007 | Rippel | F21V 21/04 248/343 |
| 8,191,877 | B2 * | 6/2012 | Lin | F16F 1/06 267/154 |
| D695,441 | S * | 12/2013 | Lui | D26/74 |
| D698,069 | S * | 1/2014 | Messisaen | D26/74 |
| 8,757,852 | B2 * | 6/2014 | Lopez | F21K 9/00 362/294 |
| 9,803,814 | B2 * | 10/2017 | Grant | F21S 8/026 |
| 10,125,959 | B2 * | 11/2018 | Cohen | F21V 21/26 |
| 2006/0164844 | A1 * | 7/2006 | To | F21S 8/02 362/382 |
| 2007/0109796 | A1 * | 5/2007 | Johnson | F21S 8/02 362/373 |
| 2009/0161370 | A1 * | 6/2009 | Johnson | F21S 8/02 362/373 |

(Continued)

*Primary Examiner* — Tsion Tumebo
(74) *Attorney, Agent, or Firm* — Chun-Ming Shih; Lanway IPR Services

(57) ABSTRACT

A downlight fixing structure is provided. The downlight fixing structure comprises a housing and a spring. The housing is for accommodating light components. The housing has an insertion lock structure on a side of the housing. The spring comprises a coil portion, a head portion, and a tail portion. The coil portion, the head portion and the tail portion are formed by the same metal wire. The head portion is inserted into the insertion lock structure.

18 Claims, 8 Drawing Sheets

(56) References Cited

U.S. PATENT DOCUMENTS

| | | | | |
|---|---|---|---|---|
| 2010/0039829 | A1* | 2/2010 | Tsai | F21S 8/026 362/373 |
| 2013/0170190 | A1* | 7/2013 | Song | F21V 21/044 362/147 |
| 2013/0322084 | A1* | 12/2013 | Ebisawa | F21V 21/04 362/269 |
| 2015/0330611 | A1* | 11/2015 | Abai | F21V 21/03 362/418 |
| 2015/0338077 | A1* | 11/2015 | Johnson | F21V 23/005 362/234 |
| 2015/0362159 | A1* | 12/2015 | Ludyjan | F21V 23/06 362/277 |
| 2016/0209018 | A1* | 7/2016 | Johnson | F21V 25/125 |
| 2017/0198870 | A1* | 7/2017 | Wu | F21V 21/046 |
| 2017/0314776 | A1* | 11/2017 | Huang | F21V 29/77 |

* cited by examiner

DOWNLIGHT WITH SPRING FIXING STRUCTURE

FIELD OF THE INVENTION

The invention relates to a downlight fixing structure. More particularly, it relates to a downlight fixing structure having springs.

BACKGROUND OF THE INVENTION

Traditional downlights have two spring fixing structures on two sides. Each spring fixing structure is axially pressed and placed in an inverse T slot. This technique has been applied in the industry for many years. The existing problem is that the installation of the spring fixing structure is complex and can only be processed by human hands, which leads to low productivity. On the other hand, an end of the spring fixing structure can get loose and slide out of the inverse T slot during an installation process because of unbalanced forces. Thus, it is in great need as to how to design a new downlight fixing structure that can have the fixing function of a spring and also can be installed by automatic machine.

SUMMARY OF THE INVENTION

One objective of the invention is to provide a downlight fixing structure in which springs can be easily inserted and locked.

Another objective of the invention is to provide a downlight fixing structure in which springs can be installed by an automatic machine.

According to one aspect of the invention, a downlight fixing structure is provided. The downlight fixing structure comprises a housing and a spring. The housing is for accommodating light components. The housing has an insertion lock structure on a side of the housing. The spring comprises a coil portion, a head portion, and a tail portion. The coil portion, the head portion and the tail portion are formed by the same metal wire. The head portion is inserted into the insertion lock structure.

According to another aspect of the invention, a downlight fixing structure is provided. A downlight fixing structure comprises a housing, a spring cover, and a spring. The housing is for accommodating light components. The spring cover is located on a side of the housing. The spring cover has a conduit with a top opening and a bottom opening. The spring cover comprises a snap-fit component below the bottom opening. The spring comprises a coil portion, a head portion, and a tail portion. The head portion is inserted into the conduit. The snap-fit component locks the head portion.

DETAILED DESCRIPTION OF THE PREFERRED EMBODIMENTS

Embodiment 1

Figure 1:
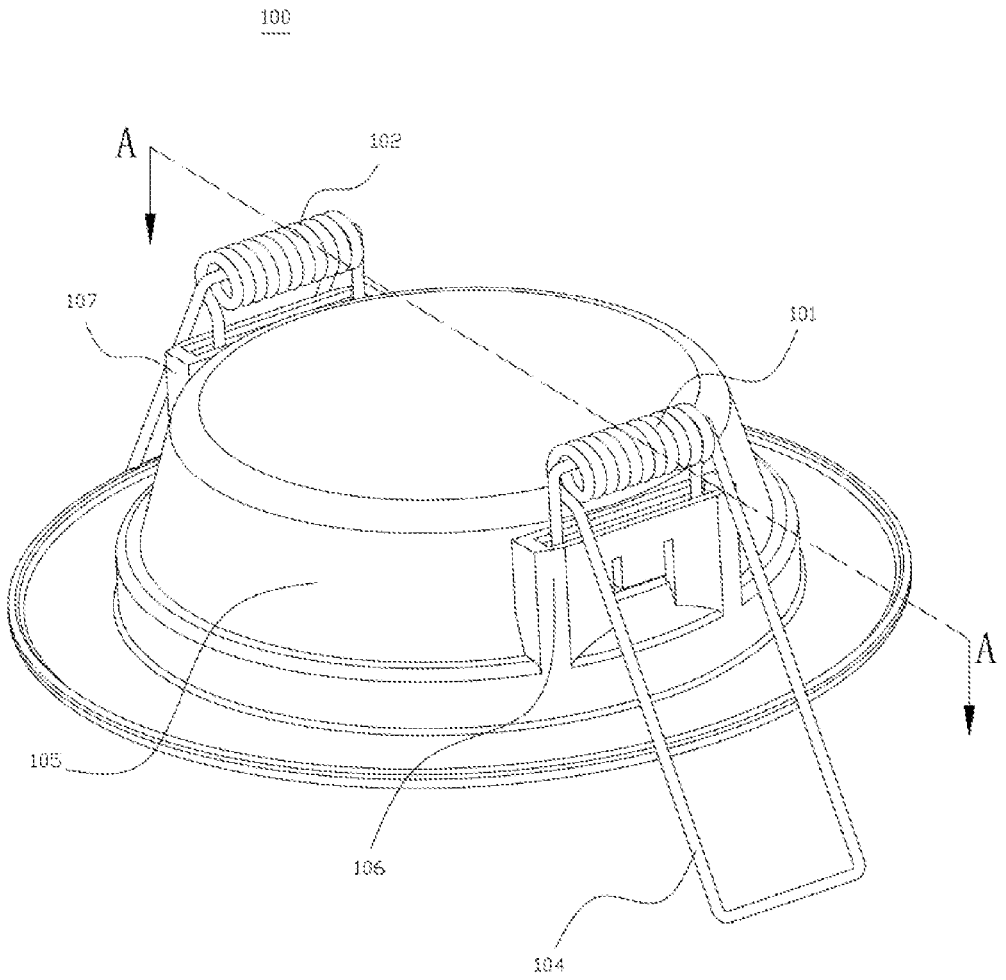
FIG. 1 shows a perspective view of an embodiment of a fixing structure of a downlight.
Figure 2:
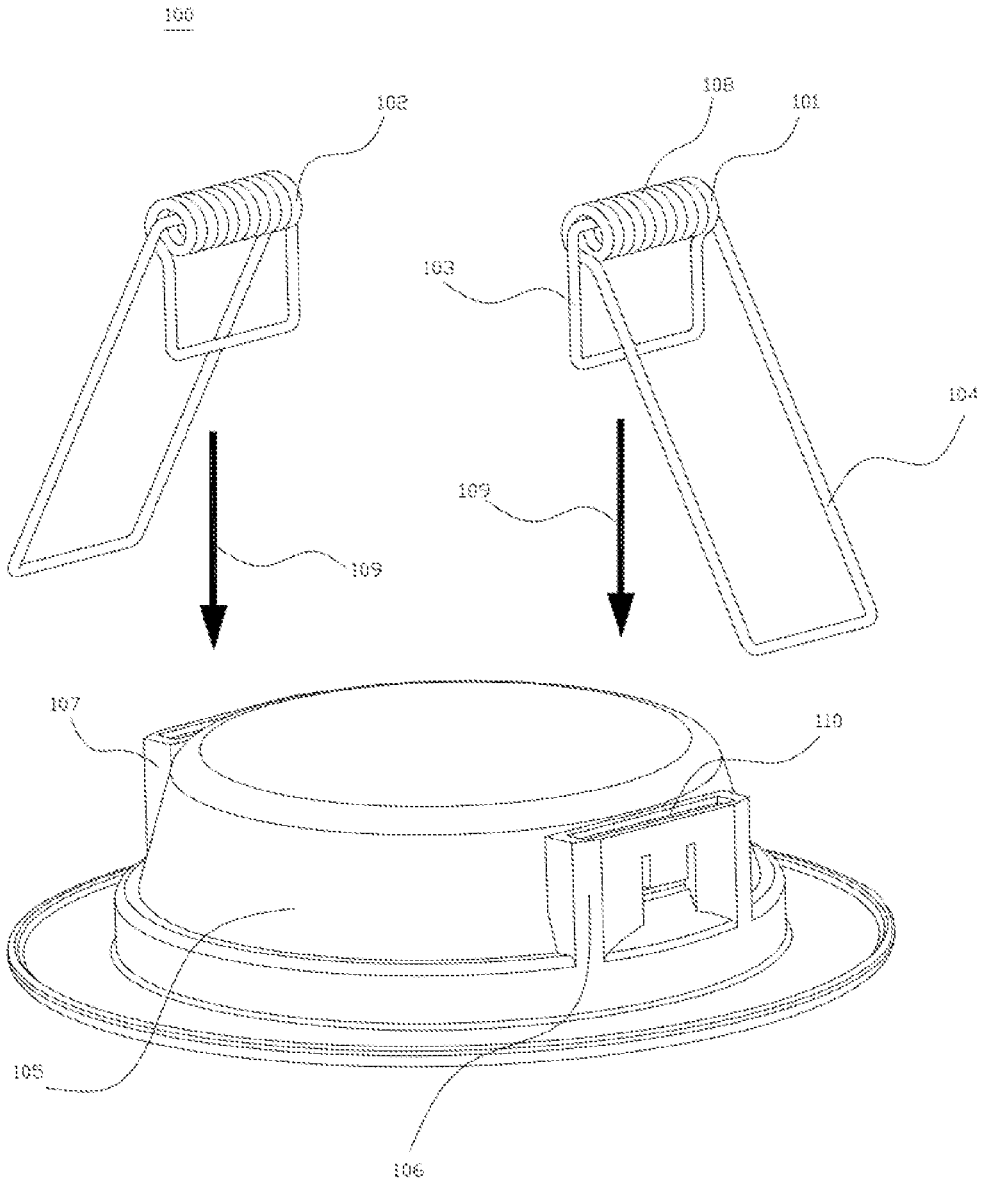
FIG. 2 is a perspective view of the fixing structure of the downlight in FIG. 1 where springs are separated from a housing.

FIG. 1 shows a perspective view of an embodiment of a fixing structure of a downlight. FIG. 2 is a perspective view of the fixing structure of the downlight in FIG. 1 where springs are separated from a housing. With reference to FIG. 1 and FIG. 2, a downlight fixing structure 100 comprises a housing 105, a spring 101, and a spring 102. The spring 101 and the spring 102 have the same structure. The housing 105 has a insertion lock structure 106 and a insertion lock structure 107. The insertion lock structure 106 and the insertion lock structure 107 are the same. The housing 105 is used for accommodating light components (not shown).

The insertion lock structure 106 and the insertion lock structure 107 are located on both sides of the housing 105. In the embodiment, the insertion lock structure 106 and the insertion lock structure are symmetrically located on both sides of the housing 105. The spring 101 comprises a coil portion 108, a head portion 103, and a tail portion 104. In some embodiments, a length of the tail portion 104 is longer than a length of the head portion 103. The head portion 103 and the tail portion 104 have a rectangular shape. The coil portion 108, the head portion 103, and the tail portion 104 are formed by the same metal wire. In this embodiment, the housing 105 is made of plastic material. In some embodiments, the housing 105 is made of metal.

An end of the head portion 103 of the spring 101 extends into an inner space of the coil portion 108 from one side of the coil portion 108, and the other end of the head portion 103 is connected to the coil portion 108 in a continuous form. An end of the tail portion 104 extends into the inner space of the coil portion 108 from the other side of the coil portion 108, and the other end of the tail portion 104 is connected to the coil portion 108 in a continuous form. In some embodiments, the length of the end of the head portion 103 extending into the coil portion 108 can reach 5 mm. The length of the end of the tail portion 104 extending into the coil portion 108 can reach 5 mm. The angle between the plane formed by the head portion 103 and that formed by the tail portion 104 is an acute angle.

When the head portion 103 and the tail portion 104 are pulled open, there is a resilient force tending to get the head portion 103 and the tail portion 104 back to the normal angle. The resilient force can help to fix the downlight onto a ceiling or a wall. With reference to FIG. 2, when the downlight is mounted onto a ceiling, the spring 101 and the spring 102 are inserted, in a direction 109, into the insertion lock structure 106 and the insertion lock structure 107 respectively.

Figure 3:
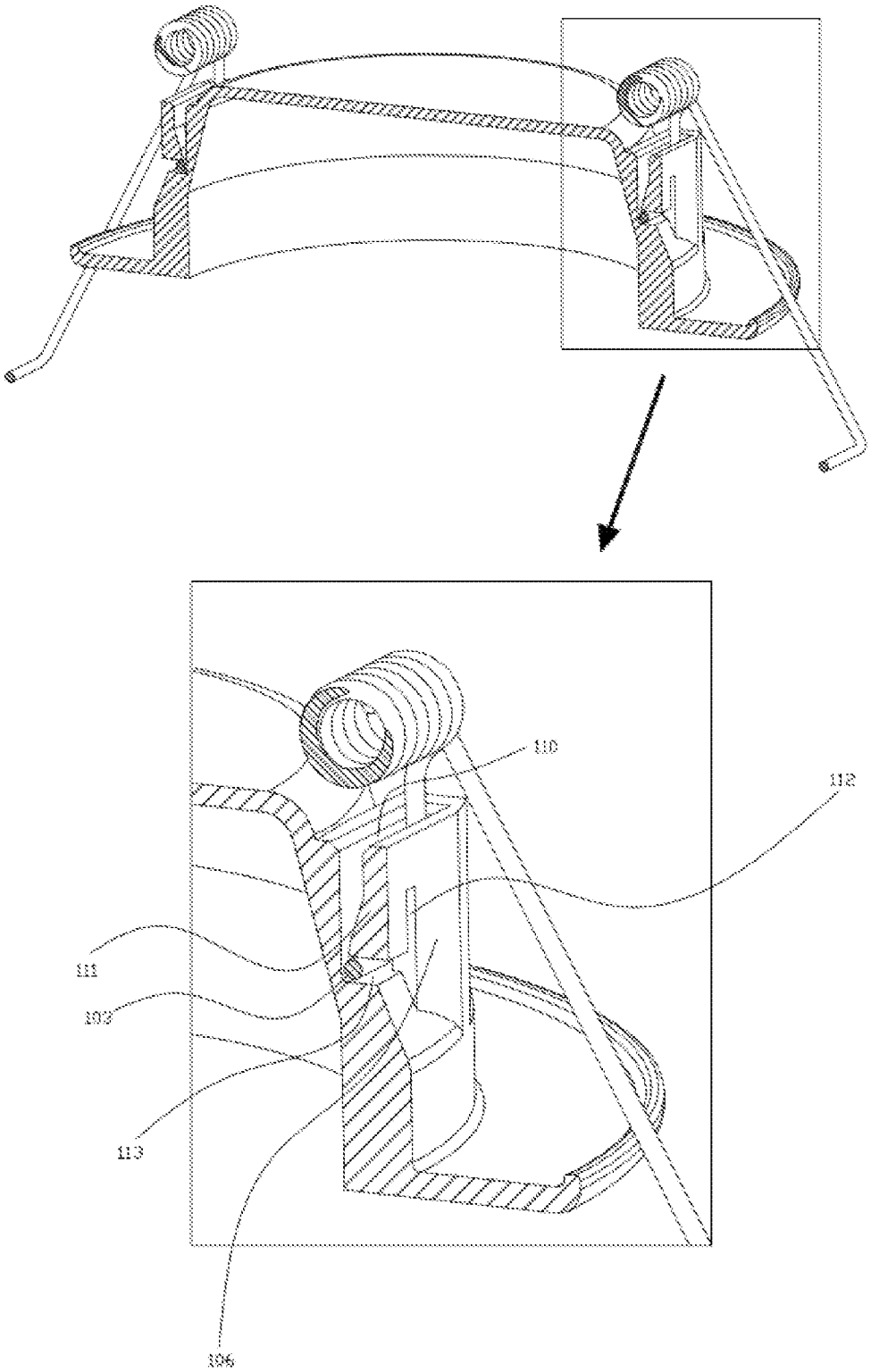
FIG. 3 is a cross-sectional view of the fixing structure of the downlight of FIG. 1 along the line A-A.

FIG. 3 is a cross-sectional view of the fixing structure of the downlight of FIG. 1 along the line A-A. With reference to FIG. 2 and FIG. 3, the insertion lock structure 106 has an opening 110. The head portion 103 of the spring 101 can be inserted into the insertion lock structure 106 through the opening 110. In this embodiment, the insertion lock structure 106 has a raised part 111. The raised part 111 is raised inwardly. When the head portion 103 of the spring 101 is inserted into the insertion lock structure 106, the raised part 111 can hold the head portion 103 in position so that the head portion 103 does not get loose or slide out. In other words, the raised part 111 help to lock the head portion 103.

In some embodiments, the raised part 111 forms a hook or barb structure to hold the head portion 103 more securely. In some embodiments, there are slit openings on lateral sides and a bottom side of the raised part 111. That is, there are vertical slit openings on the lateral sides and a horizontal opening on the bottom side of the raised part 111.

The vertical slit openings 112 and the horizontal slit opening 113 can make the raised part 111 more resilient because they allow a greater degree of bending of the raised part 111. In some embodiments, the width of the vertical slit openings 112 is preferably 1 mm and the width of the horizontal slit opening 113 is preferably 2 mm. In some embodiments, the raised part 111 does not have vertical slit openings 112. In some embodiments, the raised part 111 does not have a horizontal slit opening 113. In some embodiments, the raised part 111 is a part of the housing 105. The raised part 111 and the housing 105 are formed integrally using the same materials.

The raised part 111 is resilient, so the head portion 103 of the spring 101 can be inserted into the insertion lock structure 106 by an automatic machine. In this way, the cost of labor is saved.

Embodiment 2

Figure 4:
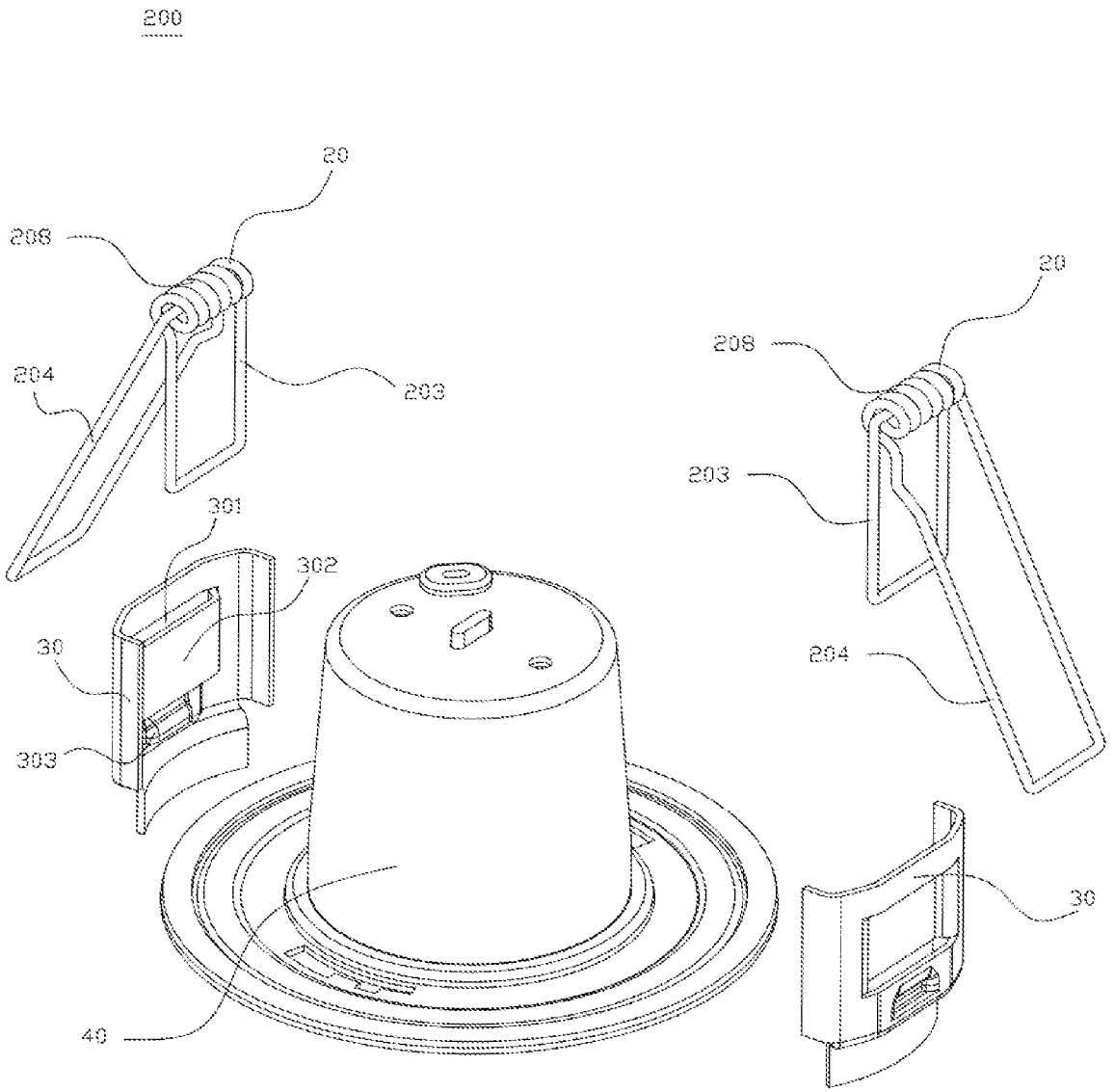
FIG. 4 is an exploded view drawing of another embodiment of the fixing structure of the downlight.
Figure 5:
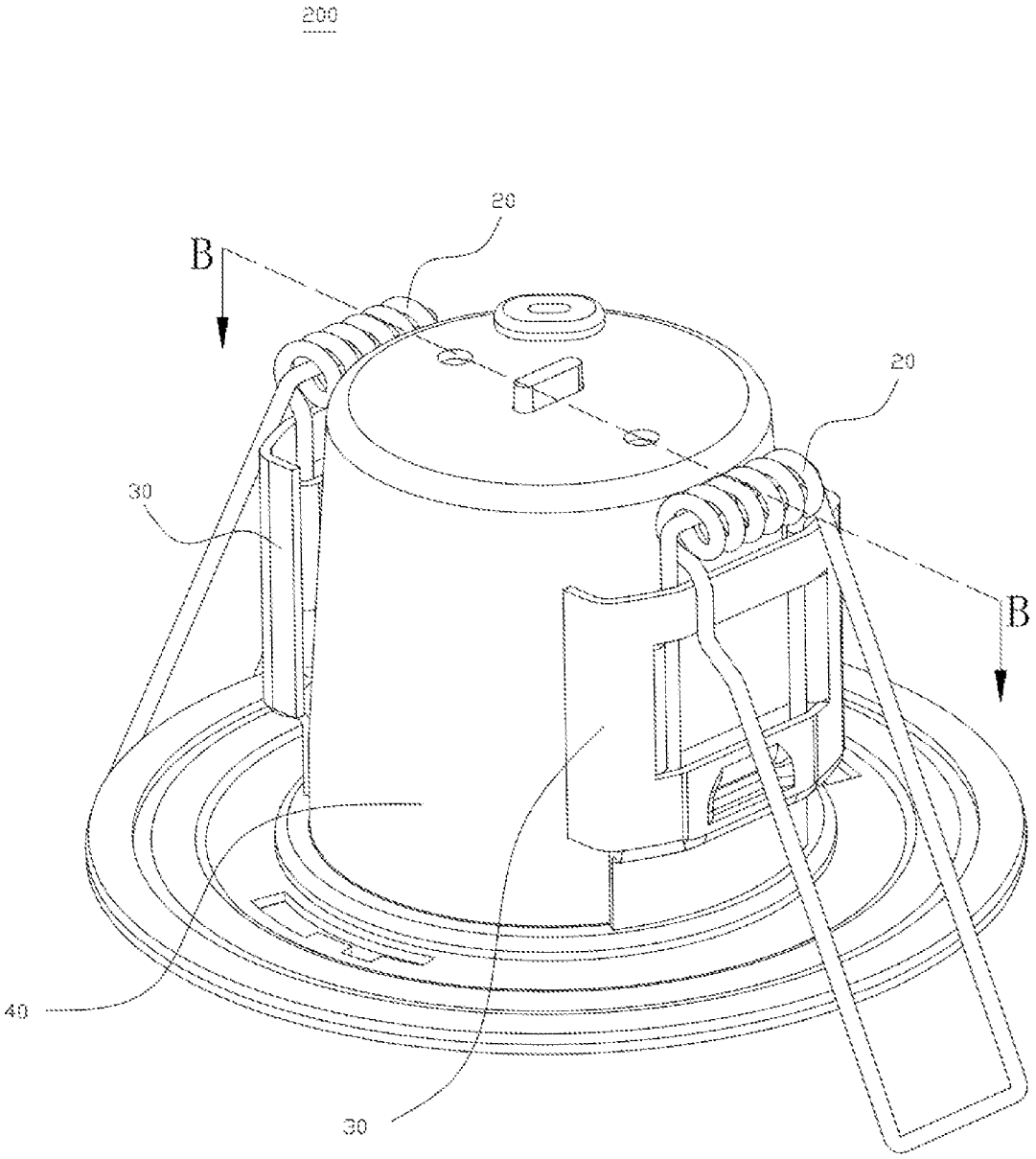
FIG. 5 shows the embodiment of FIG. 4 after being assembled.

FIG. 4 is an exploded view drawing of another embodiment of the fixing structure of the downlight. FIG. 5 shows the embodiment of FIG. 4 after being assembled. With reference to FIG. 4 and FIG. 5, the fixing structure 200 comprises a housing 40, two springs 20, and two spring covers 30. The two spring covers 30 are on both sides of the housing 40.

The spring cover 30 is a flat piece or a thin piece with small curvature. The spring cover 30 has a sunken part 302. The sunken part 302 is a part of the spring cover 30 and is formed integrally with the spring cover 30. The sunken part 302 has a top opening and a bottom opening. The sunken part 302 forms a conduit 301 with the two openings. A snap-fit component 303 is located at a lower position of the spring cover 30. The snap-fit component 303 is near the bottom opening. The spring cover 30, the sunken part 302, and the snap-fit component 303 are formed integrally. The spring 20 comprises a coil portion 208, a head portion 203, and a tail portion 204. The head portion 203 and the tail portion 204 have a rectangular shape. The head portion 203 and the tail portion 204 are formed by the same metal wire that forms the coil portion 208.

In some embodiments, the length of the tail portion 204 is longer than that of the head portion 203. The coil portion 208, the head portion 203, and the tail portion 204 are formed by the same metal wire. An end of the head portion 203 extends into an inner space of the coil portion 208 from an end of the coil portion 208. The other end of the head portion 203 is connected to the coil portion 208 in a continuous form.

An end of the tail portion 204 extends into the inner space of the coil portion 208 from the other end of the coil portion 208. The other end of the tail portion 204 is connected to the coil portion 208 in a continuous form. The head portion 203 of the spring 20 is inserted into the conduit 301 and is locked by the snap-fit component 303. In this way, the head portion 203 is locked in position in the conduit 301. The head portion 203 does not get loose or slide out of the conduit 301.

With reference to FIG. 4, the housing 40 has a space with an opening facing downwardly (not shown in the Figures). The space is used for accommodating light components (not shown in the Figures). The housing 40 can be made of metal or plastic. In this embodiment, the housing 40 is preferably made of metal. The material of the spring cover 30 can be metal or plastic. In this embodiment, the spring cover 30 is preferably made of metal. In some embodiments, the housing 40, the spring covers 30 are made of stainless steel. The thickness of the stainless steel is about 1 mm. The two spring cover 30 are mounted onto the housing 40 by spot welding. Preferably, the two spring covers 30 are symmetrically located on two sides of the housing 40.

Figure 6:
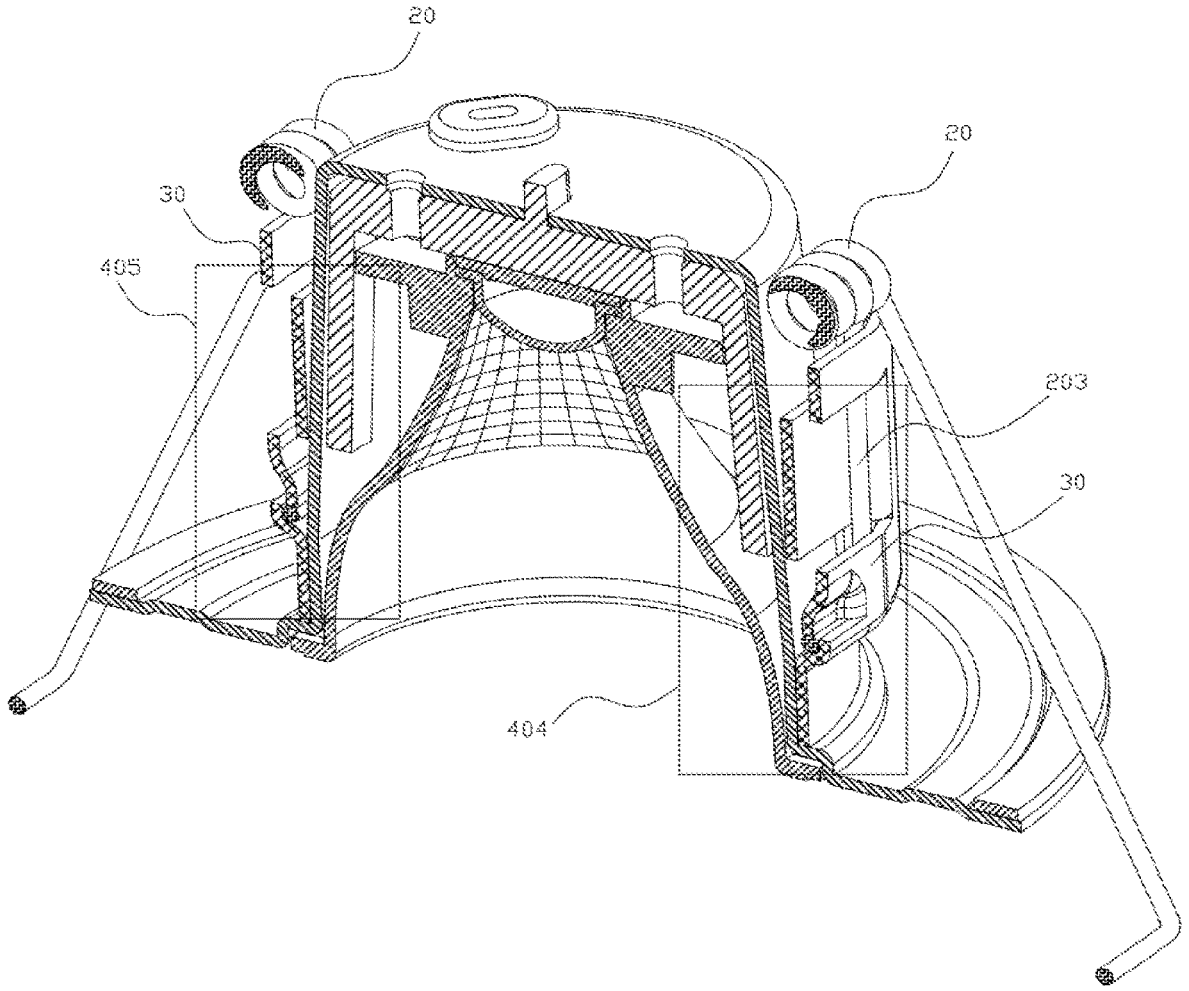
FIG. 6 is a cross-sectional view of the fixing structure of FIG. 5 along the line B-B.
Figure 7:
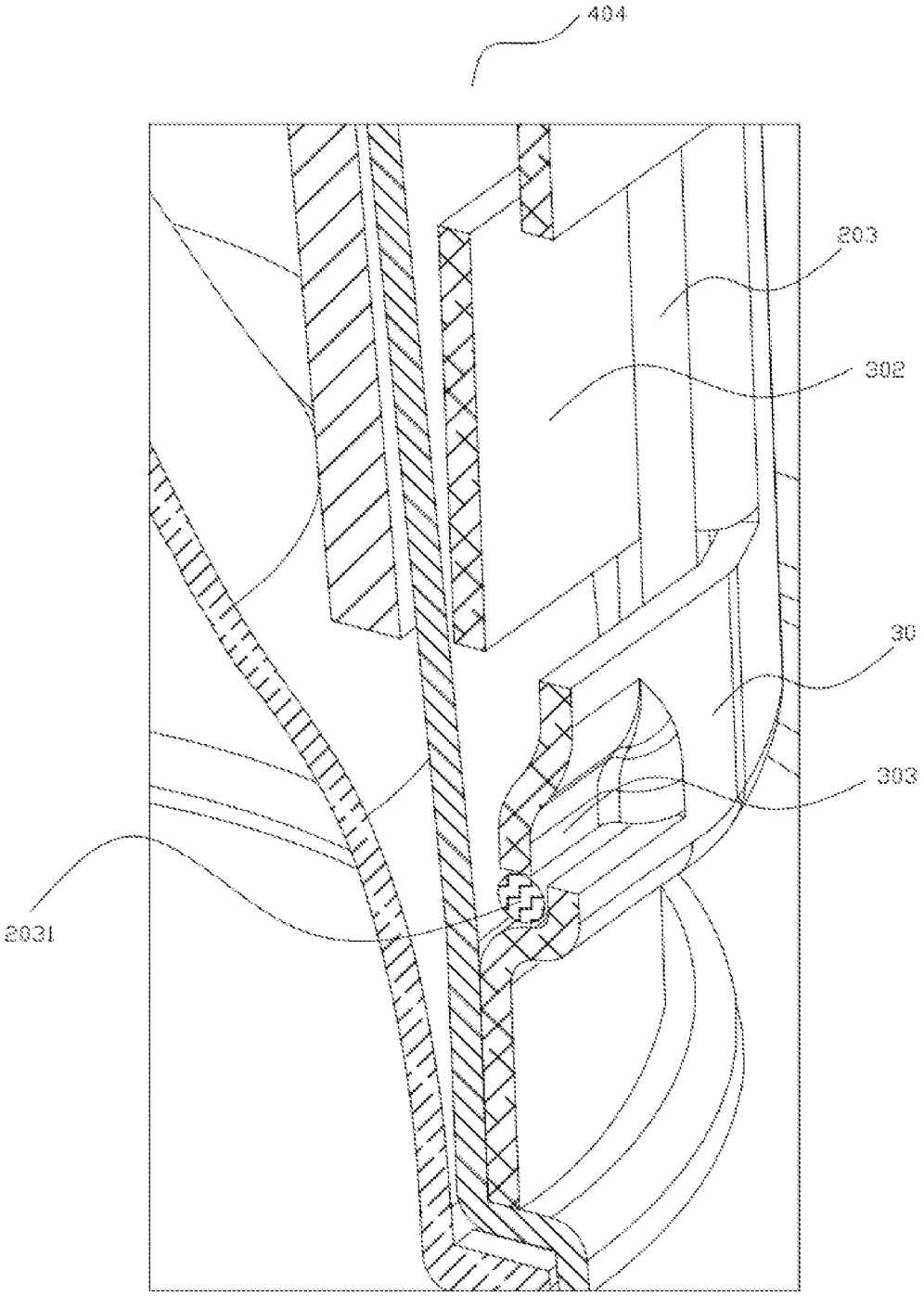
FIG. 7 is an enlarged first partial structure 404 of the cross-sectional view of FIG. 6.
Figure 8:
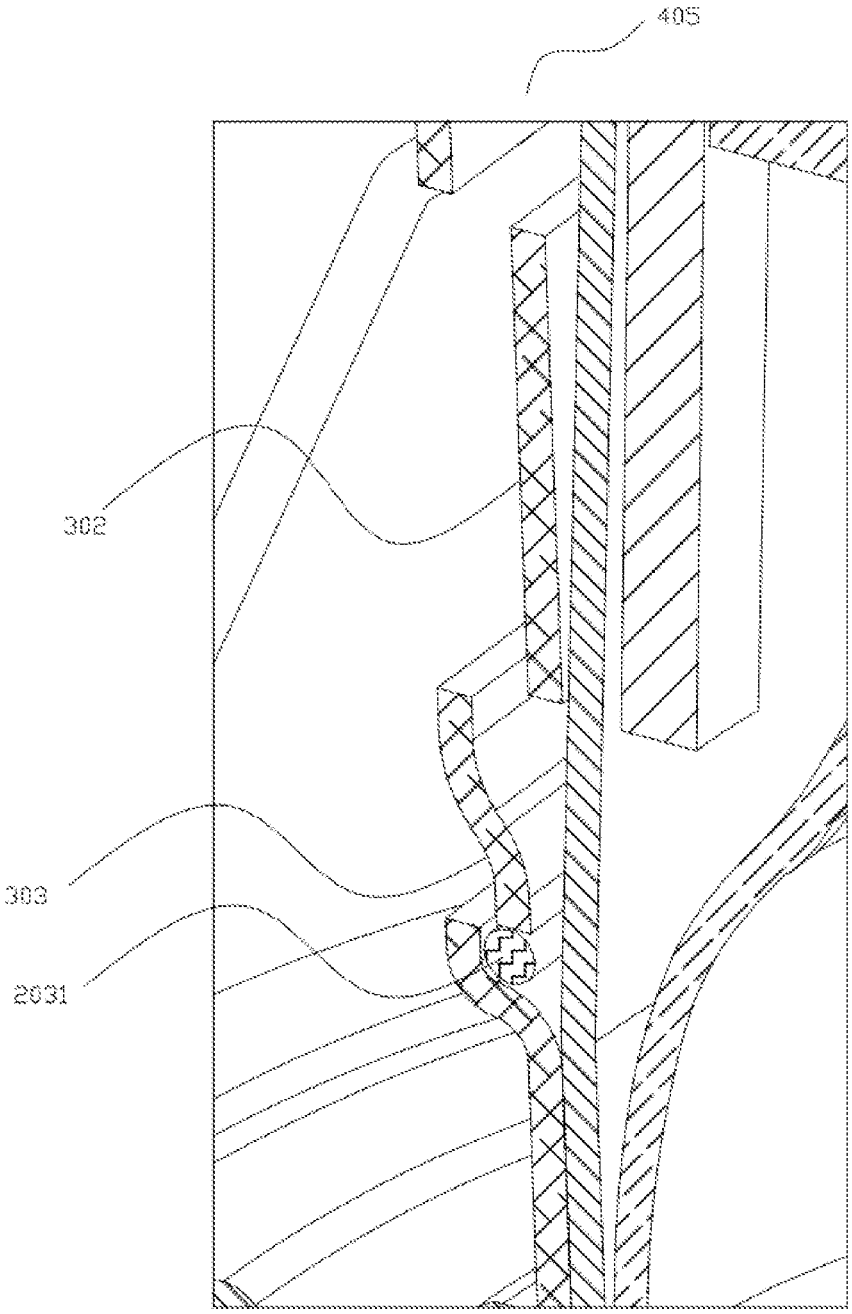
FIG. 8 is an enlarged second partial structure 405 of the cross-sectional view of FIG. 6.

FIG. 6 is a cross-sectional view of the fixing structure of FIG. 5 along the line B-B. FIG. 6 shows a first partial structure 404 and a second partial structure 405. FIG. 7 is an enlarged first partial structure 404 of the cross-sectional view of FIG. 6. FIG. 8 is an enlarged second partial structure 405 of the cross-sectional view of FIG. 6.

With reference to FIG. 4 to FIG. 7, the first partial structure 404 comprises the sunken part 302 and the snap-fit component 303. The snap-fit component 303 is connected to the spring cover 30. The snap-fit component 303 has slit openings on the lateral sides and on the bottom side. The snap-fit component 303 has an S shape curve piece and the lower part of the snap-fit component 303 is inwardly curved.

In this manner, the snap-fit component 303 is flexible and resilient. When the front end 2031 of the head portion 203 reaches the lower part of the snap-fit component 303, the front end 1031 of the head portion 203 directly locks into a space under the snap-fit component 303 because the snap-fit component 303 is flexible and resilient. Therefore, the head portion 203 of the spring 20 is locked by the snap-fit component 303 without getting loose or sliding out.

With reference to FIG. 4 to FIG. 8, the second partial structure 405 comprises the sunken part 302 and the snap-fit component 303. When the front end 2031 of the head portion 203 reaches the lower part of the snap-fit component 303, the front end 1031 of the head portion 203 directly locks into a space under the snap-fit component 303 because the snap-fit component 303 is flexible and resilient.

Therefore, the head portion 203 of the spring 20 is locked by the snap-fit component 303 without getting loose or sliding out. In some embodiments, the snap-fit component 303 forms a hook or barb structure to hold the head portion 203 more securely. In a production process, the head portion 203 of the spring 20 can be inserted into the conduit 301 of the spring cover 30 by an automatic machine, so automation of production can be realized.

The invention claimed is:

1. A downlight fixing structure, comprising: a housing for accommodating light components, the housing having an insertion lock structure on a side of the housing; a spring, the spring comprising a coil portion, a head portion, and a tail portion, wherein the coil portion, the head portion and the tail portion are formed by a same metal wire, and the head portion is inserted into the insertion lock structure; and a spring cover located on a side of the housing, the spring cover having a conduit with a top opening and a bottom opening, the spring cover comprising a snap-fit component below the bottom opening, wherein the spring cover having a sunken part, lateral sides of the sunken part being integrally connected to other part of the spring cover, the sunken part being between the top opening and the bottom opening, and wherein a top side of the snap-fit component is connected to the spring cover, and the snap-fit component has slit openings on lateral sides and a bottom side.

2. The downlight fixing structure of claim 1, wherein the insertion lock structure comprises a raised part.

3. The downlight fixing structure of claim 2, wherein the insertion lock structure comprises a barb structure.

4. The downlight fixing structure of claim 2, wherein the raised part has slit openings on both sides.

5. The downlight fixing structure of claim 1, wherein a length of the tail portion is longer than a length of the head portion.

6. The downlight fixing structure of claim 1, wherein an end of the head portion extends into an inner space of the coil portion from an end of the coil portion, the other end of the head portion is connected to the coil portion in a continuous form, an end of the tail portion extends into the inner space of the coil portion from the other end of the coil portion, and the other end of the tail portion is connected to the coil portion in a continuous form.

7. A downlight fixing structure comprising:

a housing for accommodating light components;

a spring cover located on a side of the housing, the spring cover having a conduit with a top opening and a bottom opening, the spring cover comprising a snap-fit component below the bottom opening; and a spring comprising a coil portion, a head portion, and a tail portion, the head portion being inserted into the conduit, the snap-fit component locking the head portion, wherein the spring cover having a sunken part, lateral sides of the sunken part being integrally connected to other part of the spring cover, the sunken part being between the top opening and the bottom opening, and wherein a top side of the snap-fit component is connected to the spring cover, and the snap-fit component has slit openings on lateral sides and a bottom side.

8. The downlight fixing structure of claim 7, wherein the snap-fit component has a barb structure.

9. The downlight fixing structure of claim 7, wherein the spring cover is made of metal.

10. The downlight fixing structure of claim 7, wherein a length of the tail portion is longer than a length of the head portion.

11. The downlight fixing structure of claim 7, wherein an end of the head portion extends into an inner space of the coil portion from an end of the coil portion and the other end of the head portion is connected to the coil portion in a continuous form.

12. The downlight fixing structure of claim 7, wherein an end of the tail portion extends into an inner space of the coil portion from an end of the coil portion and the other end of the tail portion is connected to the coil portion in a continuous form.

13. The downlight fixing structure of claim 7, wherein the snap-fit component is resilient and flexible.

14. The downlight fixing structure of claim 7, wherein the head portion has a rectangular shape.

15. The downlight fixing structure of claim 7, wherein the tail portion has a rectangular shape.

16. The downlight fixing structure of claim 7, wherein the snap-fit component is a curved piece of metal.

17. The downlight fixing structure of claim 7, wherein a front end of the head portion is locked into a space under the snap-fit component.

18. The downlight fixing structure of claim 7, wherein the housing is made of stainless steel.

* * * * *